US010378697B2

(12) United States Patent
Dos Passos

(10) Patent No.: US 10,378,697 B2
(45) Date of Patent: Aug. 13, 2019

(54) PORTABLE CARBON DIOXIDE ADAPTER SYSTEM

(71) Applicant: Hybrid Research Company Limited, Hong Kong (CN)

(72) Inventor: Anthony Joseph Dos Passos, Hong Kong (CN)

(73) Assignee: Hybrid Research Company Limited, Hong Kong (CN)

( * ) Notice: Subject to any disclaimer, the term of this patent is extended or adjusted under 35 U.S.C. 154(b) by 0 days.

(21) Appl. No.: 15/890,308

(22) Filed: Feb. 6, 2018

(65) Prior Publication Data

US 2018/0274728 A1 Sep. 27, 2018

(30) Foreign Application Priority Data

Mar. 22, 2017 (CN) ..... 2017 1 0173338
Mar. 22, 2017 (CN) ..... 2017 2 0282766 U

(51) Int. Cl.
*F17C 7/04* (2006.01)
*F17C 13/04* (2006.01)
*F41B 11/62* (2013.01)

(52) U.S. Cl.
CPC ..... *F17C 7/04* (2013.01); *F17C 13/04* (2013.01); *F41B 11/62* (2013.01); *F17C 2205/035* (2013.01); *F17C 2205/0329* (2013.01); *F17C 2205/0382* (2013.01); *F17C 2221/013* (2013.01); *F17C 2223/013* (2013.01); *F17C 2225/0123* (2013.01)

(58) Field of Classification Search
CPC .... F17C 7/04; F17C 13/04; F17C 2205/0329; F17C 2205/035; F41B 11/62
USPC ..... 141/351; 137/577
See application file for complete search history.

(56) References Cited

U.S. PATENT DOCUMENTS 2,021,603 A * 11/1935 Kelly, Jr. ..... F17C 13/04 15/405
2,680,546 A * 6/1954 Seaberg ..... F16L 29/007 137/321
2,731,975 A * 1/1956 Boals ..... G05D 16/10 137/116.5

(Continued)

FOREIGN PATENT DOCUMENTS

CN 201407366 Y * 2/2010
JP 2003121098 A * 4/2003

*Primary Examiner* — Timothy L Maust
*Assistant Examiner* — James R Hakomaki
(74) *Attorney, Agent, or Firm* — Bayes PLLC

(57) ABSTRACT

The present disclosure discloses a portable carbon dioxide adapter system. The system includes a first collar assembly for connecting to a liquid carbon dioxide source; a gasifying/flow adjusting assembly that converts liquid carbon dioxide into gaseous carbon dioxide and may adjust gas flow; an injection nozzle valve assembly that abuts against a gas inflow valve of a gas-injection-by-adapter object so as to inject the gaseous carbon dioxide; and a second collar assembly with one end slidably receiving the injection nozzle valve assembly and the other end being securely connected to the gasifying/flow adjusting assembly. The liquid carbon dioxide source is a disposable carbon dioxide gas cylinder, and an opening unit for piecing the disposable carbon dioxide gas cylinder is mounted within the first collar assembly; and the gasifying/flow adjusting assembly has a volume-adjustable hollow inner cavity configuration.

11 Claims, 7 Drawing Sheets

(56) References Cited

U.S. PATENT DOCUMENTS 3,648,898 A * 3/1972 Day ..... F16K 13/04 222/5
3,731,717 A * 5/1973 Potash ..... A62B 18/00 141/349
4,101,262 A * 7/1978 Neyret ..... F23Q 2/173 431/344
4,150,656 A * 4/1979 Curran ..... F41B 11/62 124/74
4,203,316 A * 5/1980 Jones ..... A61B 5/093 73/1.25
4,484,888 A * 11/1984 Grossiord ..... F23Q 2/173 431/344
4,669,975 A * 6/1987 Martinez ..... F23Q 2/173 431/344
4,999,140 A * 3/1991 Sutherland ..... B01F 3/04801 141/18
5,148,839 A * 9/1992 Kirwan ..... F17C 5/06 137/614
5,192,205 A * 3/1993 Iwahori ..... F17C 7/04 137/550
5,348,059 A * 9/1994 Carroll ..... F17C 5/00 124/70
6,334,469 B1 * 1/2002 Taniguchi ..... F17C 5/02 141/18
6,637,450 B2 * 10/2003 Huang ..... F17C 13/04 124/74
6,932,128 B2 * 8/2005 Turan, Jr. ..... B25F 5/00 141/37
7,059,343 B2 * 6/2006 Carroll ..... G06Q 10/10 137/505.25
7,163,008 B2 * 1/2007 Stevens ..... F16K 1/303 124/73
7,757,681 B2 * 7/2010 Gabrel ..... F41B 11/724 124/73
9,140,518 B2 * 9/2015 Tseng ..... F41B 11/62
9,423,206 B2 * 8/2016 Annuzzi, Jr. ..... F41B 11/62
9,518,800 B2 * 12/2016 Colby ..... F41B 11/723
9,593,905 B2 * 3/2017 Tseng ..... F41B 11/62
2001/0050076 A1 * 12/2001 Colby ..... F41B 11/724 124/74
2003/0094195 A1 * 5/2003 Huang ..... F17C 13/04 137/68.3
2004/0107951 A1 * 6/2004 D'Arcy ..... F41B 11/62 124/74
2008/0078769 A1 * 4/2008 Crunkleton, III .... B67D 1/0021 220/560.04
2009/0078321 A1 * 3/2009 Arnott ..... F17C 13/00 137/14
2009/0229591 A1 * 9/2009 Gabrel ..... F41B 11/62 124/73
2015/0059726 A1 * 3/2015 Harvey ..... F41C 23/22 124/73
2015/0225048 A1 * 8/2015 Lee ..... B63C 9/19 141/329
2016/0215890 A1 * 7/2016 Muzzo ..... F17C 13/04
2017/0284602 A1 * 10/2017 Song ..... F17C 7/04

* cited by examiner

PORTABLE CARBON DIOXIDE ADAPTER SYSTEM

FIELD OF THE INVENTION

The present disclosure relates to a portable carbon dioxide adapter system, and more particularly to a portable carbon dioxide adapter system for pressurizing and injecting gas to a gas-injection object such as an airgun or an airsoft apparatus by a disposable carbon dioxide high pressure gas cylinder.

BACKGROUND OF THE INVENTION

Using power from a compressed gas is one of most common approaches to shoot a projectile for an airsoft that shoots a BB bullet (i.e., a 6 mm or 8 mm spherical plastic projectile) or an airgun (such as an air rifle) that shoots a metal projectile. Common compressed gases include propane, green gas (mixture of propane and a very small amount of silicone oil), HFC-134a, carbon dioxide, and the like. Compared with other gases, liquid carbon dioxide stores amazing energy and has an ideal greenhouse effect index (the ability of a gas to absorb thermal energy under the same temperature and the same pressure). This is why carbon dioxide high pressure gas cylinders are widely applied to airguns (e.g., air rifles). Some airsoft guns (for example, air pistols), which are specially designed to withstand high pressure gas, may also use carbon dioxide to shoot a BB bullet.

In the airgun and airsoft industries, gas pressure potential energy is usually stored in a 12 g compressed carbon dioxide gas cylinder for direct use, or gas is injected into a gas storage cavity inside a gun body or a fixed gas tank connected to the gun body by a hand pump, an air compressor or a scuba tank. Although large volume (e.g., 88 g) disposable compressed carbon dioxide gas cylinders are commercially available, they can only be directly used by very few airguns. Therefore, a carbon dioxide adapter designed for the large volume (e.g., 88 g) disposable compressed carbon dioxide gas cylinders is desired, which may safely inject gas to and pressurize the gas storage cavity or fixed gas tank while avoiding leakage of carbon dioxide. In this way, it is convenient for users to use the large volume disposable compressed carbon dioxide gas cylinders for various gas-injection objects including those in the airgun industry.

SUMMARY OF THE INVENTION

To solve the above problems existing in the prior art, an objective of the present disclosure is to provide a large volume disposable compressed carbon dioxide gas cylinder that is convenient for users to use, and a portable carbon dioxide adapter system that pressurizes and injects gas to various kinds of gas-injection objects.

A technical solution of the present disclosure discloses a portable carbon dioxide adapter system, comprising: a first collar assembly for connecting to a liquid carbon dioxide source; a gasifying/flow adjusting assembly that converts liquid carbon dioxide into gaseous carbon dioxide and may adjust gas flow; an injection nozzle valve assembly that abuts against a gas inflow valve of a gas-injection-by-adapter object so as to inject the gaseous carbon dioxide; and a second collar assembly with one end slidably receiving the injection nozzle valve assembly and the other end being securely connected to the gasifying/flow adjusting assembly, wherein the liquid carbon dioxide source is a disposable carbon dioxide gas cylinder, and an opening unit for piecing the disposable carbon dioxide gas cylinder is mounted within the first collar assembly; and the gasifying/flow adjusting assembly has a volume-adjustable hollow inner cavity configuration.

Preferably, in a portable carbon dioxide adapter system according to the technical solution above, the injection nozzle valve assembly comprises a nozzle valve rod, an embedded sealing ring, an end sealing collar, an end locking cap, and a tension spring, wherein the nozzle valve rod slidably passes through a central through-hole of the second collar assembly, one end of the nozzle valve rod being a hollow nozzle hole, the other end thereof being a solid screw; in a peripheral direction of the nozzle valve rod is provided an annular groove receiving the embedded sealing ring, and meanwhile in a diameter direction of the nozzle valve rod is provided a gas inflow hole in communication with the hollow nozzle hole; compared with the gas inflow hole, the annular groove is disposed closer to the hollow nozzle hole side; the end sealing collar is mounted on the solid screw of the nozzle valve stem and is secured through the end locking cap.

Preferably, in the portable carbon dioxide adapter system according to the technical solution above, the end sealing collar maintains sealing between the injection nozzle valve assembly and the gasifying/flow adjusting assembly in a non-gas-injecting state, while releases the sealing between the injection nozzle valve assembly and the gasifying/flow adjusting assembly in a gas-injecting state.

Preferably, in the portable carbon dioxide adapter system according to the technical solution above, the gasifying/flow adjusting assembly comprises a gasification cavity body, a flow adjusting screw, a sealing piston, a pressure adjusting spring, and a locking bolt, wherein inside the gasification cavity body is provided the hollow inner cavity configuration; in two end faces of the gasification cavity body are provided a liquid carbon dioxide inflow hole and a gaseous carbon dioxide outflow hole, respectively; a through-hole having threads at both ends is provided in a direction perpendicular to the two end faces of the gasification cavity body; the flow adjusting screw is mounted to one end of the through-hole in a threaded manner, and the locking bolt tightly locks the pressure adjusting spring at the other end of the through-hole.

Preferably, in the portable carbon dioxide adapter system according to the technical solution above, an end of the flow adjusting screw is provided with a sealing gasket, the sealing piston being mounted between the pressure adjusting spring and the flow adjusting screw.

Preferably, the portable carbon dioxide adapter system according to the technical solution above further comprises: a sealing ring and guard ring assembly disposed between the opening unit and the gasifying/flow adjusting assembly, the sealing ring and the guard ring assembly being comprised of an O-shaped sealing ring and a silica gel guard ring, a center of the silica gel guard ring being provided with a through-hole.

Preferably, in the portable carbon dioxide adapter system according to the technical solution above, the opening unit is a drill tip-type opening unit.

Preferably, in the portable carbon dioxide adapter system according to the technical solution above, the first collar assembly and the second collar assembly are connected to the gasifying/flow adjusting assembly in a threaded manner and are locked by a locking pin.

Preferably, in the portable carbon dioxide adapter system according to the technical solution above, the second collar is a stepped cylinder, a fixed end of which connected to the gasifying/flow adjusting assembly is provided with an internal thread, while a free end on the opposite side is provided with an external thread.

According to a preferred technical solution of the present invention, a carbon dioxide adapter designed for a large volume, e.g., 88 g, disposable compressed carbon dioxide gas cylinder is provided, which may securely inject gas to and pressurize the gas storage cavity or fixed gas storage tank so as to avoid leakage of the carbon dioxide, thereby facilitating users to use a large volume disposable compressed carbon dioxide gas cylinder in various gas-injection objects including those in the airgun industry.

The features, technical effects and other advantages of the present disclosure will become obvious through further illustrations below in conjunction with the accompanying drawings.

BRIEF DESCRIPTION OF THE ACCOMPANYING DRAWINGS

Now, the present disclosure will be described through examples with reference to the accompanying drawings, in which.

DETAILED DESCRIPTION OF THE PREFERRED EMBODIMENTS

Figure 1:
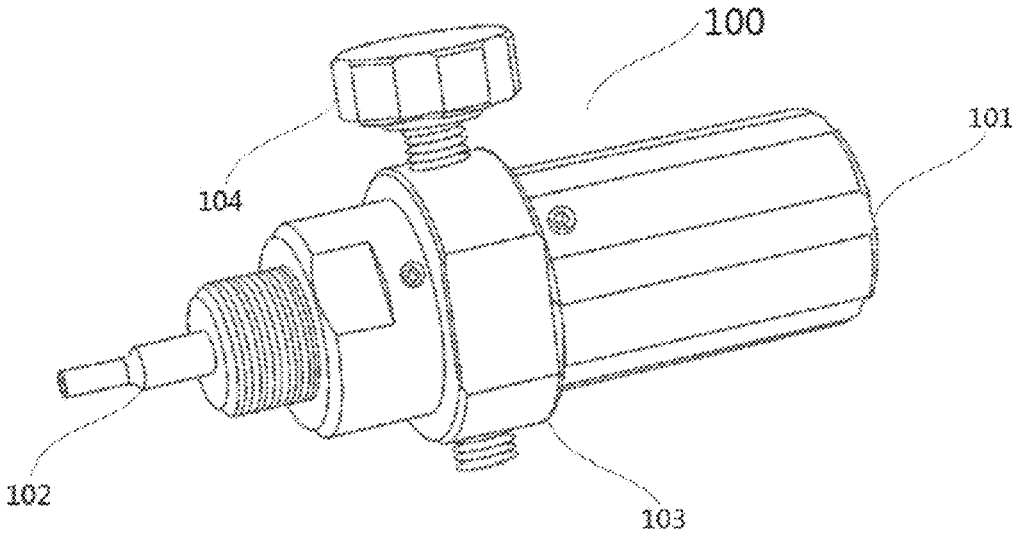
FIG. 1 is a perspective view of a portable carbon dioxide adapter system according to a preferred embodiment of the present disclosure.

Hereinafter, the technical solution of the present disclosure will be described in a clear and comprehensive manner in conjunction with the drawings. It is apparent that the embodiments as described here are only part of the embodiments of the present disclosure, rather than all of them. All other embodiments obtained by a person of normal skill in the art on the basis of the embodiments in the present disclosure fall within the protection scope of the present disclosure.

It should be noted that, in the description of the present disclosure, orientations or positional relationships indicated by the terms "front/back," "up/down," "left/right," "vertical/horizontal," and "in/out" and the like, which are based on the orientations or position relationships illustrated in the drawings, are merely for the purposes of describing the present disclosure and simplifying the description, rather than indicating or implying that the devices or elements as referred to must have particular orientations or must be constructed and operated with specific orientations; therefore, they should not be understood as limiting the present disclosure. In addition, the terms "first," "second," and "third" are used for descriptive purposes only, and should not be construed to indicate or imply relative importance.

In the description of the present disclosure, it should be noted that, unless explicitly specified or limited, the term "mount," "connect," and "connected" should be understood broadly. For example, they may be a fixed connection, or a detachable connection, or an integral connection; they may be a mechanical connection, or may be an electrical connection; they may be a direct connection, or may be an indirect connection through an intermediate medium, or may be a communication inside two elements. For a person of normal skill in the art., the specific meanings of the terms above in the present disclosure may be understood according to specific conditions.

FIG. 1 is an assembly structure diagram of a portable carbon dioxide adapter system 100 according to a preferred embodiment of the present disclosure. As shown in FIG. 1, the portable carbon dioxide adapter system 100 in an assembled state comprises: a connection port 101 for connecting to a liquid carbon dioxide source; an injection nozzle 102 for injecting gaseous carbon dioxide to a gas-injection object; a gasifying section 103 that converts liquid carbon dioxide into gaseous carbon dioxide; and an adjuster 104 for adjusting carbon dioxide flow, wherein the connection port 101 is preferably connected to a large volume disposable compressed carbon dioxide gas cylinder (not shown) in a threaded manner. The disposable compressed carbon dioxide gas cylinder (e.g., CO2-88G) stores inside liquid carbon dioxide and is provided with an external thread at a gas cylinder outlet; a corresponding internal thread is provided inside the connection port 101, thereby achieving a reliable engagement between the two threads. In the airgun or airsoft industry, valve rods of gas inflow valves of various gas-injection objects (including gas-injectable 12 g gas cylinders) are substantially of the same type and size. Therefore, the injection nozzle 102 may inject gas to almost all airguns or airsoft products. Hereinafter, all products, which use high pressure carbon dioxide and may be injected with gas using the injection nozzle 102, are collectively referred to as gas-injection-by-adapter objects.

To facilitate user operation, as shown in FIG. 1, optionally an external thread is provided on an outer periphery of an adapter collar which receives the injection nozzle 102, for further attaching hoses and other input nozzles according to user needs, thereby implementing direct gas-injection to the gas-injection-by-adapter object. Inside the gasifying section 103 is a volume-adjustable cavity structure. The adjuster 104 adjusts the volume of an internal cavity of the gasifying section 103 through a conventional screw configuration and a pressure adjusting spring, thereby controlling carbon dioxide flow. The specific structures of the gasifying section 103 and the adjuster 104 will be further described with reference to the accompanying drawings.

Figure 2A:
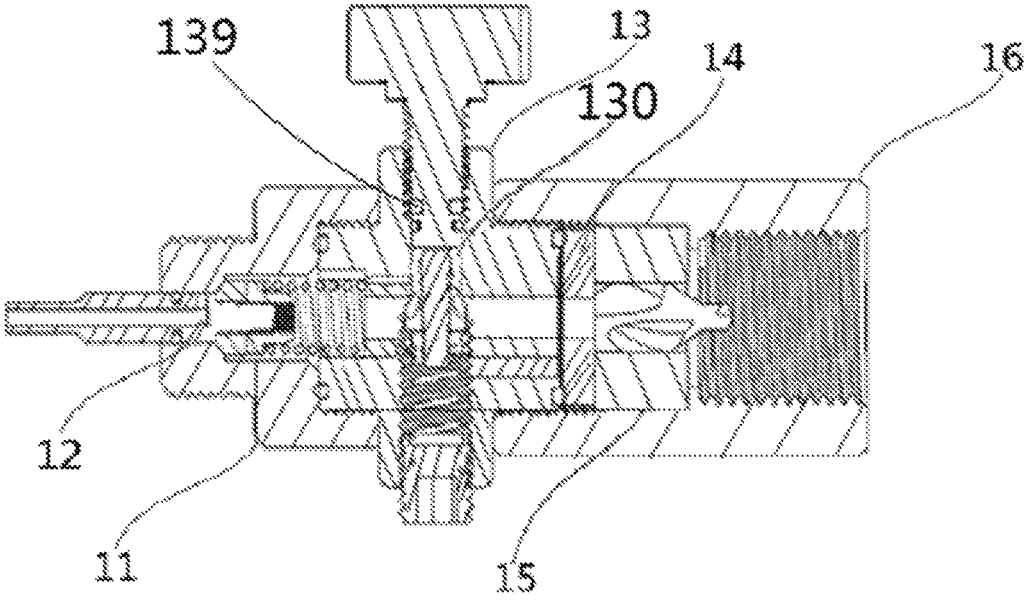
FIG. 2A is a plane sectional view of the portable carbon dioxide adapter system of FIG. 1.
Figure 2B:
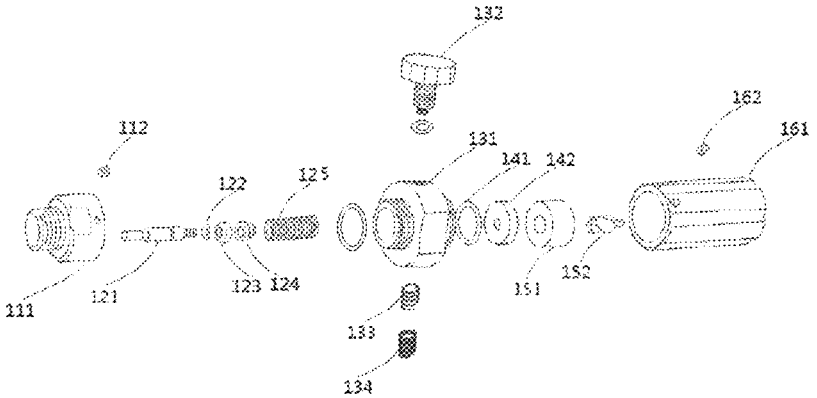
FIG. 2B is a perspective view of the portable carbon dioxide adapter system of FIG. 1.

FIG. 2A is a plane sectional view of the portable carbon dioxide adapter system 100 of FIG. 1. FIG. 2B is an exploded structure diagram of the portable carbon dioxide adapter system 100 of FIG. 1. Hereinafter, respective components of the portable carbon dioxide adapter system 100 of FIG. 1 and working manners thereof will be elaborated with reference to the plane section view of FIG. 2A and the structural exploded diagram of FIG. 2B.

As shown in FIG. 2A, various components making up the portable carbon dioxide adapter system 100 may be partitioned into the following assemblies by functions: an adapter collar assembly 11, an injection nozzle valve assembly 12, a gasifying/flow adjusting assembly 13, a sealing ring and guard ring assembly 14, a composite drill bit assembly 15, and a gas cylinder collar assembly 16. When injecting gas to a gas-injection-by-adapter object, the carbon dioxide enters from the composite drill bit assembly 15 into the portable carbon dioxide adapter system 100 along an assembly axial direction from right to left, and is finally injected into the gas-injection-by-adapter object from the injection nozzle valve assembly 12.

FIG. 2B further shows structural details of respective components that make up the portable carbon dioxide adapter system 100 along a horizontal assembly axis from left to right. As shown in FIG. 2B, the adapter collar assembly 11 comprises a collar body 111 and a locking pin 112. A left end of the collar body 111 is provided with a stepped through-hole within which the injection nozzle valve assembly 12 is received in a slidable manner; a right end of the collar body 111 is connected to the gasifying/flow adjusting assembly 13 in a threaded manner. Specifically, a right end of the collar body 111 is provided with an internal thread, while a left end of the gasifying/flow adjusting assembly 13 is correspondingly provided with an external thread, such that the collar body 111 and the gasifying/flow adjusting assembly 13 are engaged in a threaded manner, and an airtight structure is implemented in a connected state via an O-shaped sealing ring (not shown). The locking pin 112 is for the purpose of preventing thread loosening, such that the adapter collar assembly 11 is securely locked to the gasifying/flow adjusting assembly 13 during the gas-injection process.

The injection nozzle valve assembly 12 comprises a nozzle valve rod 121, an embedded sealing ring 122, an end sealing collar 123, an end locking cap 124, and a tension spring 125. The nozzle valve rod 121 is a stepped cylinder with outer diameters of two ends being smaller than an outer diameter of a central part; a left end of the nozzle rod is a hollow nozzle hole for injecting carbon dioxide gas, and a right end of the gas cylinder is a solid screw for engaging the end locking cap 124; on the larger-diameter central part of the cylinder is provided with an annular groove for receiving the embedded sealing ring 122; the embedded sealing ring 122 is for slidably sealing between the nozzle valve rod 121 and the adapter collar assembly 11 so as to avoid leakage of the carbon dioxide gas to an outer atmosphere during the gas-injection process. In addition, between the annular groove of the nozzle valve rod 121 and a right end face of the larger-diameter cylinder is further provided a gas inflow hole that is completely or partially through in the diameter direction and communicates with the nozzle hole. The end sealing collar 123 abuts against a right end face of the larger-diameter cylinder of the nozzle valve rod 121 and is secured through the end locking cap 124; the outer diameter of the end sealing collar 123 is larger than a left end through hole of the adapter collar assembly 11, such that the end sealing collar 123, when being tensioned by the tension spring 125, ensures sealing between the injection nozzle valve assembly 12 and the gasifying/flow adjusting assembly 13 in a non-gas-injection state. A left end of the tension spring 125 is snapped to a right end bulge of the end locking cap 124, while a right end of the tension spring 125 abuts against a left end face of the gasifying/flow adjusting assembly 13. When injecting gas to the gas-injection-by-adapter object, as the tension spring 125 is compressed, the sealing between the injection nozzle valve assembly 12 and the gasifying/flow adjusting assembly 13 is released, and the gas inflow hole of the nozzle valve rod 121 is exposed, such that high-pressure carbon dioxide gas enters into the gas inflow hole and reaches the hollow nozzle hole at the left end of the nozzle valve rod 121. Those skilled in the art will easily appreciate that by appropriately disposing the annular groove of the nozzle valve rod 121 and setting a maximum compressed amount of the tension spring 125, it is guaranteed that during the gas-injection process, the carbon dioxide only enters into the gas inflow hole, without compromising the slidable sealing of the embedded sealing ring 122.

The gasifying/flow adjusting assembly 13 comprises a gasification cavity body 131, a flow adjusting worm 132, a pressure adjusting spring 133, and a locking bolt 134. The gasification cavity body 131 has a hollow inner cavity configuration 130 (as shown in FIG. 2A) of a locally threaded hole that is top-down through; meanwhile, a gaseous carbon dioxide outflow hole 138 is provided on a left end face of the gasification cavity body 131, and a liquid carbon dioxide inflow hole 137 is provided on a right end face of the gasification cavity body 131; preferably, the liquid carbon dioxide inflow hole 137 is greater than the gaseous carbon dioxide outflow hole 138, so as to prevent blockage or unsmooth flowing of the liquid carbon dioxide due to surface tension. Left and right ends of the gasification cavity body 131 are of an external thread structure, for being correspondingly engaged with inner threads of the adapter collar assembly 11 and the gas cylinder collar assembly 16, respectively. Preferably, a left end face of the gasifying cavity body 131 is of an inwardly recessed structure so as to securely receive the tension spring 125 of the injection nozzle valve assembly 12. The flow adjusting screw 132, the pressure adjusting spring 133, and a locking bolt 134 are connected or mounted in the top-down through locally threaded hole of the gasifying cavity body 131 so as to adjust the volume of the hollow inner cavity 130 of the gasifying cavity body 131. Preferably, a sealing gasket 139 (as shown in FIG. 2A) is provided at an end of the flow adjusting screw 132, and a sealing piston (not shown) is mounted on the pressure adjusting spring 133; both of the sealing gasket 139 and the sealing piston are for sealing the gasifying cavity body 131, avoiding leakage of the gasified carbon dioxide to the outside. The specific structures of respective components of the gasifying/flow adjusting assembly 13 as well as assembly manners thereof will be further illustrated with reference to the drawings.

The sealing ring and guard ring assembly 14 comprises an O-shaped sealing ring 141 and a silica gel guard ring 142. The O-shaped sealing ring 141 is for sealing between the gasification/flow adjusting assembly 13 and the gas cylinder collar assembly 16, which prevents the silica gel guard ring 142 from blocking the liquid carbon dioxide inflow hole on the right end face of the gasifying cavity body 131. The silica gel guard ring 142 can buffer an impact from the composite drill bit assembly 15, and a central opening of the silica gel guard ring 142 allows the liquid carbon dioxide to smoothly enter the gasifying/flow adjusting assembly 13 from the disposable carbon dioxide gas cylinder 13.

The composite drill bit assembly 15 comprises a drill bit-type opener 151 and a hollow drill bit holder 152. The hollow drill bit holder 152 is used to fixedly support the drill bit-type opener 151; a spiral groove shape of the drill-bit type opener 151 can ensure that the liquid carbon dioxide flows smoothly to the gasification cavity when the disposable carbon dioxide gas cylinder is opened. The hollow drill-bit holder 152 is a hollow cylinder, a left end face of which abuts against the sealing ring and the silica gel guard ring 142 of the collar assembly 14, and a right end face of which abuts against an inner annular flange of the gas cylinder collar assembly 16. In a state of use, the drill-bit type opener 151 held by the hollow drill bit holder 152 extends out of the hollow drill bit holder 152 and beyond the inner annular flange of the gas cylinder collar assembly 16 so as to open the disposable carbon dioxide gas cylinder. Additionally and alternatively, the hollow drill bit holder 152 and the drill-bit type opener 151 may also adopt an integrated structure instead of the split structure shown in the figure.

The gas cylinder collar assembly 16 comprises a gas cylinder collar body 161 and a locking pin 162. A left end of the gas cylinder collar body 161 is connected to a right end of the gasification/flow adjusting assembly 13 in a threaded manner. Likewise, the locking pin 162 is used for preventing thread loosening, such that the gas cylinder collar assembly 16 is securely locked to the gasification/flow adjusting assembly 13 during the gas-injection process. As mentioned above, the right end of the gas cylinder collar body 161 is used for being connected to a carbon dioxide source, that is, connected to a large volume disposable compressed carbon dioxide gas cylinder (e.g., CO2-88G) in a threaded manner.

Figure 3:
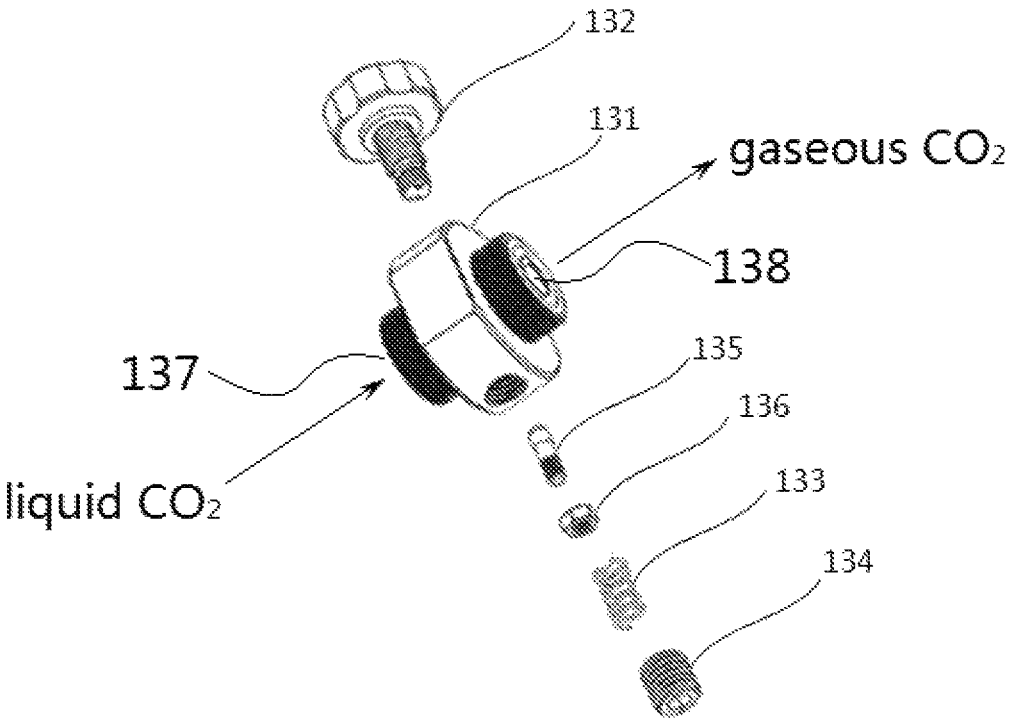
FIG. 3 is a perspective view of a gasification/flow adjusting section in the portable carbon dioxide adapter system according to a preferred embodiment of the present disclosure.

FIG. 3 is a diagram showing structural details of a gasification/flow adjusting section in the portable carbon dioxide adapter system according to a preferred embodiment of the present disclosure. When gas is injected to a gas-injection-by-adapter object by the large volume disposable carbon dioxide gas cylinder, it is important to ensure safe release of gas pressure potential energy and adjustability of the gas flow. The gasification/flow adjustment section according to a preferred embodiment of the present disclosure may achieve this point through a simple structure. As indicated by the arrow of FIG. 3, the liquid carbon dioxide flows in from a small hole in the left end face of the gasification cavity body 131 and is ejected out of a small hole in the right end face of the gasification cavity body 131 in a gaseous form after gasification and expansion in an inner cavity of the gasification cavity body 131; the strength of the special-metal-made gasification cavity body 131 can withstand high-pressure carbon dioxide, so that the gas pressure potential energy can be ensured to be safely released. In order to adjust flow of the gasified carbon dioxide, a through hole (with internal threads being provided at both ends) is opened in the gasification cavity body 131 along a direction perpendicular to a flowing direction of the carbon dioxide indicated by the arrow, and a dimension of gasification space inside the gasification cavity body 131 is adjusted by screwing the flow adjusting screw 132 within the through hole, thereby achieving the purpose of adjusting the flow of carbon dioxide. In order to ensure the sealing effect while adjusting the flow, a sealing gasket 139 (as shown in FIG. 2A) is arranged at an end of the flow adjusting screw 132, and meanwhile the sealing piston is assembled above the pressure adjusting spring 133 in the through hole, so that the sealing piston abuts against the flow adjusting screw 132; the sealing piston comprises a piston rod 135 with a sealing collar and a piston cap 136 for securing the sealing collar. The locking bolt 134 is used for locking the pressure adjusting spring 133 in the through hole. As described above, the sealing piston and the sealing gasket 139 are used for sealing the gasification cavity body 131 so as to prevent leakage of the gasified carbon dioxide to the outside.

Figure 4A:
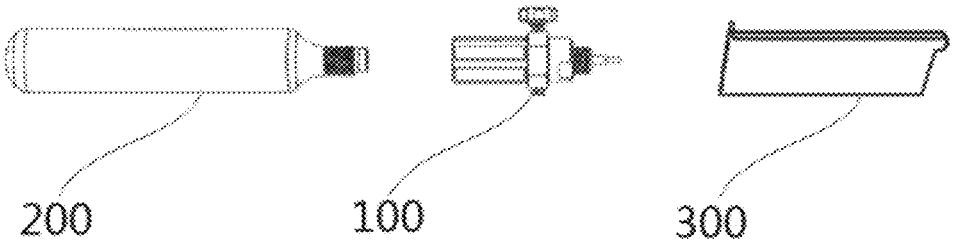
FIGS. 4A-4C are schematic diagrams showing use states of the portable carbon dioxide adapter system according to a preferred embodiment of the present disclosure.
Figure 4B:
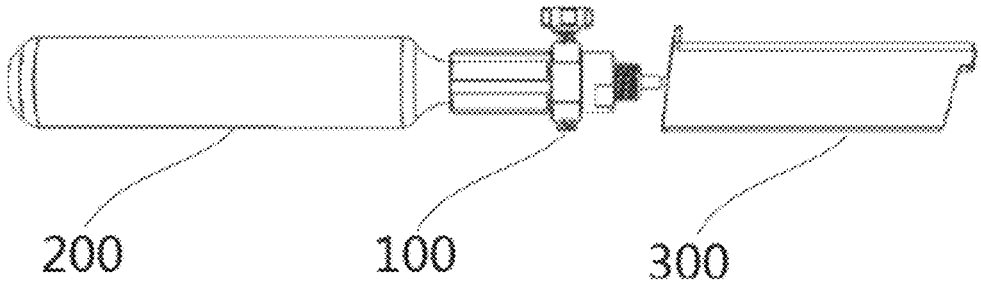
Figure 4C:
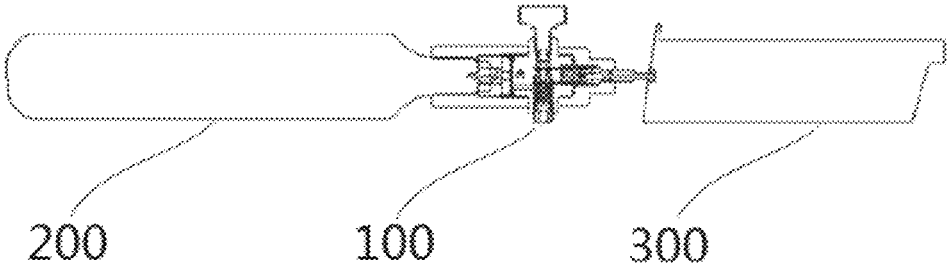

FIGS. 4A-4C are schematic diagrams showing use states of the portable carbon dioxide adapter system according to a preferred embodiment of the present disclosure. As shown in FIGS. 4A-4C, in the use states, an operator connects one end of the portable carbon dioxide adapter system 100 to a disposable carbon dioxide gas cylinder 200 in a threaded manner; meanwhile, the operator presses tightly the other end till the valve rod of the gas inflow valve of the gas-injection object 300 to pressurize and inject gas; besides, the flow of gas injection may be adjusted through the gasification/flow adjusting section. Therefore, it is very convenient to use. Those skilled in the art will readily appreciate that the gas-injection object 300 can be a gas storage cavity within the gun body or a fixed gas storage tank which is connected with the gun body, and can also be various products including gas-injectable 12 g gas cylinders. Therefore, the portable carbon dioxide adapter system 100 according to the present disclosure has a wide industrial application and is not limited to the airsoft or airgun industry.

The above disclosed are only preferred embodiments of the present disclosure, and the scope of the invention are not defined thereby, of course. Therefore, any equivalent changes within the patent application scope of the present disclosure fall within the scope of the invention. It is to be understood that the above description is intended to be illustrative and not restrictive. For example, the embodiments described above (and/or aspects thereof) may be used in combination with one another. In addition, many modifications may be made to adapt a particular situation or material according to the teachings of the invention without departing from the scope of the invention. By reading the description above, many other embodiments and modifications within the scope and spirit of the claims will be apparent to those skilled in the art.

What is claimed is:

1. A portable carbon dioxide adapter system, comprising:
- a first collar assembly for connecting to a liquid carbon dioxide source;
- a gasifying/flow adjusting assembly having one end connected to the first collar assembly, wherein the gasifying/flow adjusting assembly converts liquid carbon dioxide into gaseous carbon dioxide and has a volume-adjustable hollow inner cavity configuration;
- a second collar assembly connected to the other end of the gasifying/flow adjusting assembly;
- a drill bit assembly for opening the liquid carbon dioxide source; and
- an injection nozzle valve assembly for abutting against a gas inflow valve of a gas-injection object so as to inject the gaseous carbon dioxide;
  - wherein, the drill bit assembly comprises a hollow drill bit holder and a drill-bit type opener having a spiral groove shape;
  - and
  - wherein, the injection nozzle valve assembly comprises a nozzle valve rod, an embedded sealing ring, an end sealing collar, an end locking cap, and a tension spring; the nozzle valve rod slidably passes through a central through-hole of the second collar assembly, a first end of the nozzle valve rod being provided with a hollow nozzle hole and a second end thereof being a solid screw and being provided in a diameter direction of the nozzle valve rod with a gas inflow hole in communication with the hollow nozzle hole; the embedded sealing ring is disposed closer to the first end than the gas inflow hole; the end sealing collar is mounted on the solid screw and is secured through the end locking cap; a first end of the tension spring is snapped to the end locking cap, and a second end thereof abuts against an end face of the gasifying/flow adjusting assembly.

2. The portable carbon dioxide adapter system according to claim 1, wherein an outer diameter of the end sealing collar is larger than the central through-hole of the second collar assembly, such that the end sealing collar, when being tensioned by the tension spring, maintains sealing between the injection nozzle valve assembly and the gasifying/flow adjusting assembly in a non-gas-injecting state.

3. The portable carbon dioxide adapter system according to claim 2, wherein the tension spring is compressed in a gas-injecting state, such that the sealing between the injection nozzle valve assembly and the gasifying/flow adjusting assembly is released, and the gas inflow hole is exposed.

4. The portable carbon dioxide adapter system according to claim 1, wherein the nozzle valve rod is a stepped cylinder with outer diameters of two end portions being smaller than an outer diameter of a central part; the nozzle valve rod is provided on the central part in a peripheral direction of the nozzle valve rod with an annular groove receiving the embedded sealing ring; and the end sealing collar abuts against an end face of the central part.

5. The portable carbon dioxide adapter system according to claim 1, wherein the gasifying/flow adjusting assembly comprises a gasification cavity body, a flow adjusting screw, a sealing piston, a pressure adjusting spring and a locking bolt; a liquid carbon dioxide inflow hole and a gaseous carbon dioxide outflow hole are provided, respectively, at two ends of the gasification cavity body; a through-hole connecting the two ends is provided in a direction perpendicular to a flowing direction of carbon dioxide; the flow adjusting screw is mounted to one end of the through-hole in a threaded manner and adjusts a gasification space inside the gasification cavity body; and the locking bolt is mounted to the other end of the through-hole.

6. The portable carbon dioxide adapter system according to claim 5, wherein a first end of the flow adjusting screw is provided with a sealing gasket, and the sealing piston comprises a piston rod with a sealing collar and a piston cap for securing the sealing collar; and the pressure adjusting spring is located between the sealing piston and the locking bolt, and causes the sealing piston to abut against the flow adjusting screw.

7. The portable carbon dioxide adapter system according to claim 1, further comprising:

a sealing ring and guard ring assembly located between the drill bit assembly and the gasifying/flow adjusting assembly, the sealing ring and guard ring assembly comprising an O-shaped sealing ring and a guard ring; wherein, the guard ring is provided with a through-hole at its center, and the O-shaped sealing ring is located between an end face of the guard ring and an end face of the gasifying/flow adjusting assembly.

8. The portable carbon dioxide adapter system according to claim 7, wherein the hollow drill bit holder is a hollow cylinder, with one end face abutting against the guard ring and the other end face abutting against an inner annular flange of the first collar assembly; and the drill-bit type opener extends out of the hollow drill bit holder and beyond the inner annular flange.

9. The portable carbon dioxide adapter system according to claim 1, wherein the first collar assembly and the second collar assembly are connected to the gasifying/flow adjusting assembly in a threaded manner, and are locked by locking pins.

10. The portable carbon dioxide adapter system according to claim 9, wherein the second collar assembly is a stepped cylinder; and a fixed end of the second collar assembly connected to the gasifying/flow adjusting assembly is provided with an internal thread, and a free end thereof on the opposite side is provided with an external thread.

11. The portable carbon dioxide adapter system according to claim 1, wherein the liquid carbon dioxide source comprises a disposable carbon dioxide cylinder; and the gas-injection object comprises an airgun or an airsoft apparatus.

* * * * *